United States Patent [19]

Gray

[11] 4,084,469

[45] Apr. 18, 1978

[54] WEB CUTTING DEVICE

[76] Inventor: Herbert Ray Gray, 26 Russell St., Littleton, Mass. 01460

[21] Appl. No.: 751,387

[22] Filed: Dec. 17, 1976

[51] Int. Cl.[2] ..... B26F 3/00

[52] U.S. Cl. ..... 83/542; 83/523; 83/600; 83/651.1

[58] Field of Search ..... 83/651.1, 542, 600, 83/623, 523, 56, 801, 807, 818, 814; 30/116, 117

[56] References Cited

U.S. PATENT DOCUMENTS

| | | | |
|---|---|---|---|
| 831,610 | 9/1906 | Hummer | 30/117 X |
| 2,158,667 | 5/1939 | Rieck et al. | 30/117 X |
| 3,055,251 | 9/1962 | Krikorian | 83/651.1 X |

*Primary Examiner*—J. M. Meister
*Attorney, Agent, or Firm*—Kenway & Jenney

[57] ABSTRACT

A cutting apparatus, suitable for cutting or shearing a moving web, comprises first and second wire segments that contact each other at substantially a single point and includes means for causing the point of contact to travel along the length of the wire segments to accomplish the cutting of a web positioned between the wire segments.

12 Claims, 6 Drawing Figures

WEB CUTTING DEVICE

BACKGROUND OF THE INVENTION

This invention relates to a cutting apparatus suitable for cutting a moving web into segments.

Many paper and fabric products are manufactured on production lines that include continuous webs of material travelling at high speeds while they are coated, treated, or otherwise operated upon. Such webs are typically cut at some point in the process into segments of a desired size. Although it is highly desirable, from a production point of view, to run the webs at the highest possible speeds, such high speeds complicate the cutting process. In fact, at very high speeds virtually all available cutting apparatuses are unworkable.

A common prior cutting arrangement has simply been to reciprocally drive a cutting blade positioned above the web in a down-and-up stroke. In order to cut a momentarily stationary segment of the web, various web clamping arrangements have been proposed to instantaneously clamp the web upstream of the cutting blade during the actual cutting operation. At very high web speeds, however, a quantity of web can "pile up" behind the clamping arrangement and this slack must be taken up before the next cutting cycle can begin. Furthermore, the speed of operation of such a cutting apparatus is itself limited. As can be appreciated, even with large driving systems, the typically heavy cutting blade has a limited speed of movement in its down-and-up cutting cycle. One example of a blade-type cutting apparatus is shown in Soderberg U.S. Pat. No. 2,130,818.

As is explained in detail below, the present invention contemplates the use of crossed wire segments, employing a moving point of contact, as a cutting system. Although wire-type cutters have been known in the past, typically they have been employed in cutting situations not facing the problems of high speed moving webs that are to be transversely cut. For example, single wire cutters are shown in Keck U.S. Pat. No. 3,838,621 and in Schumacher U.S. Pat. No. 1,197,553. In the Schumacher arrangement a single wire interacts with an elongated frame to define the cutting point and in the Keck patent non-interacting cutting wires longitudinally cut blocks of clay into brick-shaped elements.

Three U.S. Pat. Nos. to Criner (2,110,290; 2,182,281; and 2,906,309) all disclose band saw-type cutting devices in which the saw blade is twisted to form a figure eight. A series of these figure eight saw blades is employed for bread slicing operations.

As will be evident to those skilled in the art, none of these prior suggestions is particularly suitable for solving the problem of efficiently and neatly providing a continuous series of transverse cuts across the width of a web moving at high speeds.

OBJECTS AND SUMMARY OF THE INVENTION

In view of the above discussion, it is a principal object of the present invention to provide a cutting device capable of transversely cutting a rapidly moving web.

It is an additional object of the invention to provide such a cutting device which is simple to manufacture, efficient in operation, and easy to maintain.

Briefly, a cutting apparatus according to the present invention includes first and second wire segments that contact each other at substantially a single point and also includes a means for maintaining the wire segments taut and means for moving at least one of the wire segments relative to the other to cause the point of contact to move along the segments in a cutting motion.

Preferably, the first and second wire segments comprise segments of a single continuous wire wound in a "figure 8" loop around two pairs of supporting discs, each disc itself supported on a rotatable beam. The rotation of the beams through limited arcs with opposite senses of rotation causes the point of contact of the wire segments (i.e., the cutting point) to move in a direction from one end of the beams to the other end of the beams.

Further constructional and operational details of preferred embodiments of the invention are found below in the detailed description, as well as the claims.

BRIEF DESCRIPTION OF THE DRAWINGS

Other objects features, and advantages of the invention will appear from the following description of a particular preferred embodiment which is illustrated in the accompanying drawings. In the drawings.

DETAILED DESCRIPTION OF A PARTICULAR PREFERRED EMBODIMENT

Figure 1A:
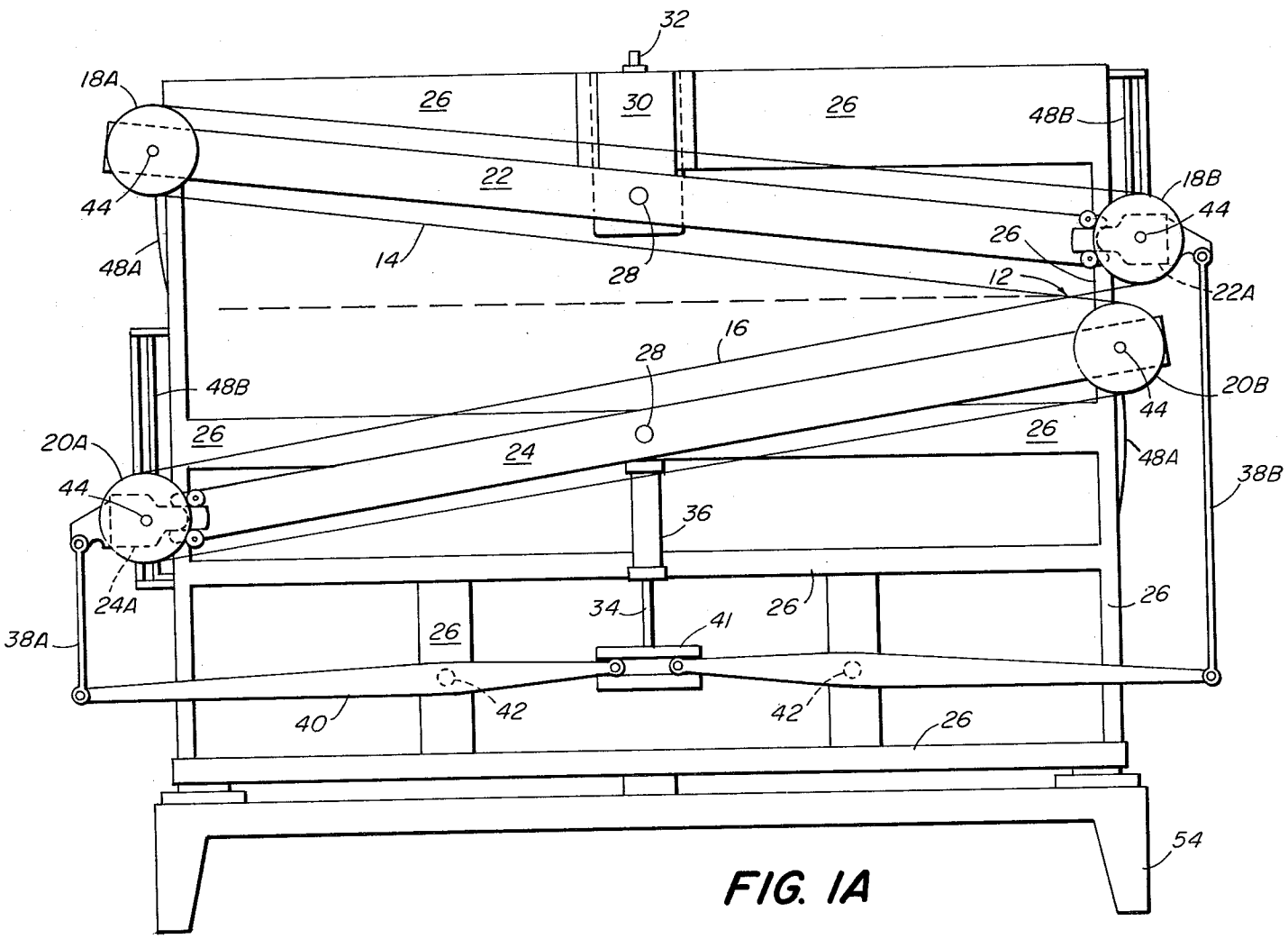
FIGS. 1A, 1B, and 1C are front elevations of a cutting device constructed in accordance with the present invention showing successive stages of a cutting sequence.
Figure 1B:
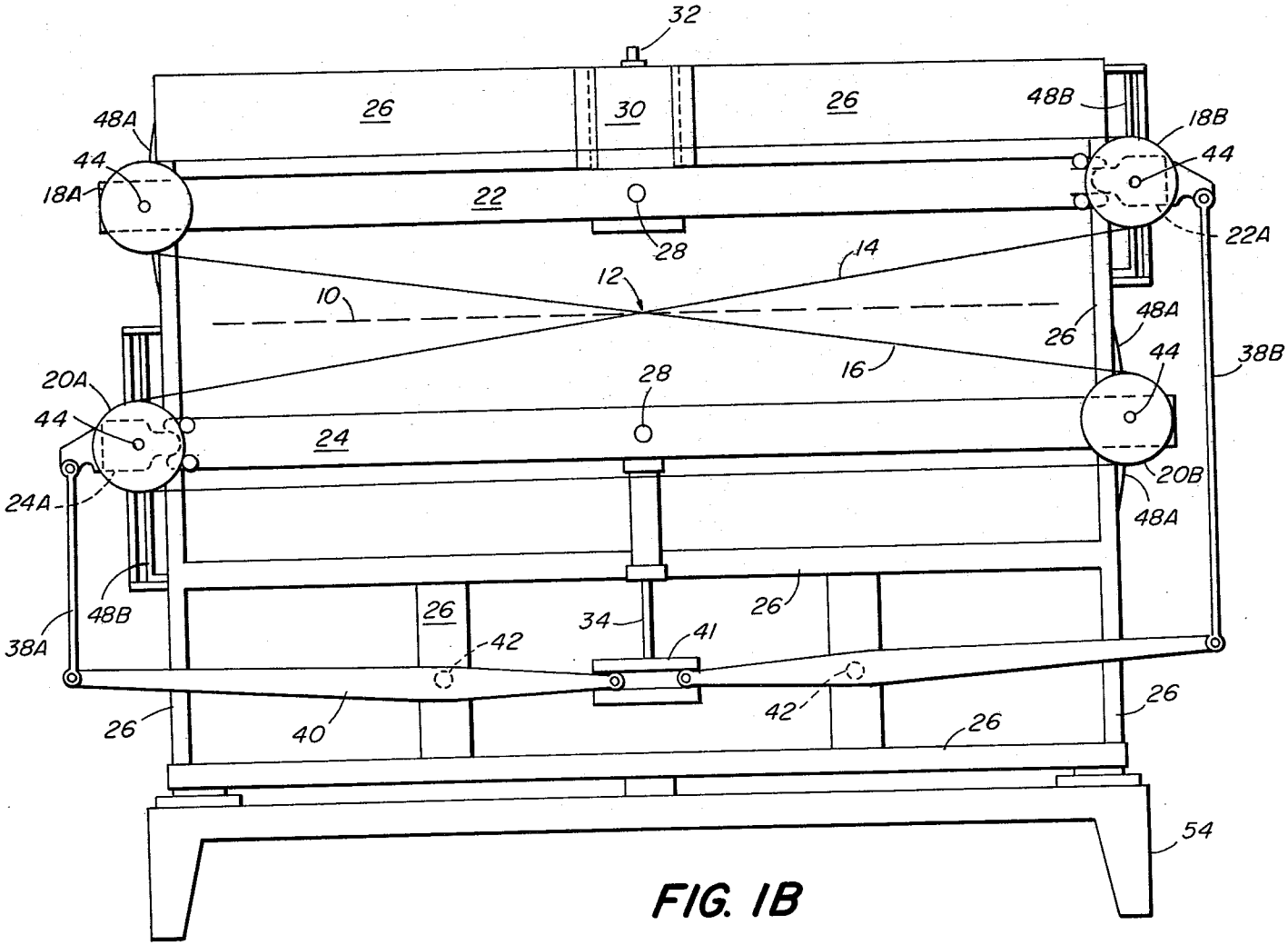
Figure 1C:
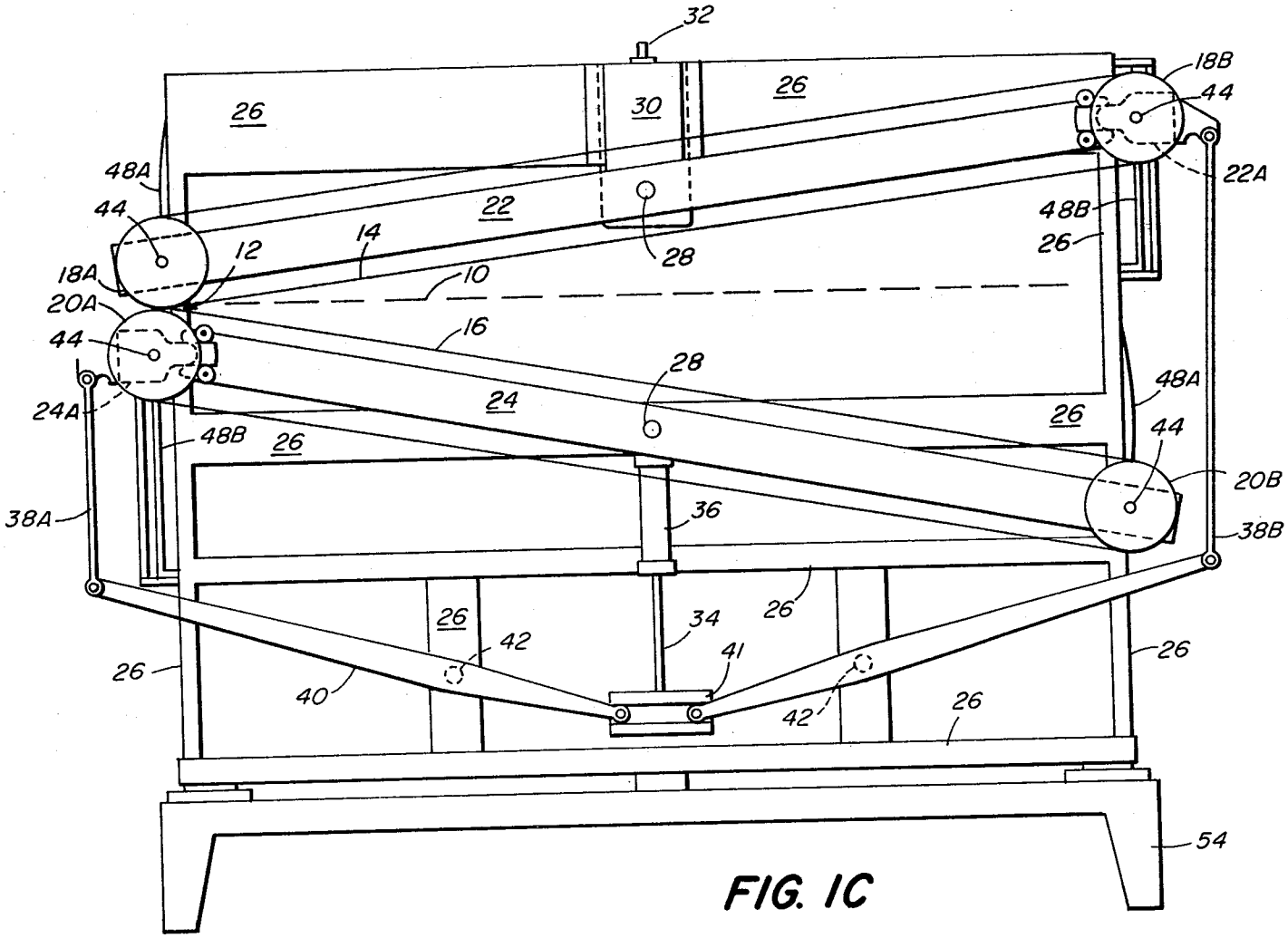

In FIGS. 1A–1C, the reference character 10 indicates the plane at which the moving web is fed through the cutting apparatus. Actual cutting of the web at plane 10 is accomplished by the moving point of contact 12 between two lengths 14, 16 of an endless loop of wire. The wire is trained about pairs of pulleys **18*a*, 18*b* and 20*a*, 20*b* in a "figure 8" pattern (best seen in FIG. 1B). Pulleys 18*a*, 18*b* are mounted on a first arm or beam 22 and pulleys 20*a*, 20*b* are mounted on a second arm or beam 24. The beams are pivotally mounted on a frame 26 at pivots 28 which are centered in the beams 22, 24. The pivot 28 of arm 22 is secured to a movable portion 30 of the frame 26. The portion 30 can be moved up and down by a screw arrangement 32**. This facilitates adjusting the tautness on the wire, as well as permitting the removal and replacement of the wire.

The moving point of contact 12 between wire segments 14, 16 (compare FIGS. 1A, 1B, 1C) is provided by a 180° out-of-phase rocking motion of the beams 22, 24 about their pivots. This motion is illustrated by a comparison of FIGS. 1A–1C. In FIG. 1A, each of the beams 22, 24 has been rocked to an extreme orientation such that the point of contact 12 between the wire segments is adjacent the pulleys **18*b* and 20*b*. Rotation of the arm 22 in a counterclockwise direction results in the orientation of FIG. 1B, in which the point of contact 12 is travelled to the center of the device. Continued rotation results in the orientation of FIG. 1C in which the point of contact 12 is now at the extreme left side of the device adjacent the pulleys 18*a* and 20*a*. Reversed rotation of the two arms 22, 24 results in the point of contact 12 travelling back to the right side of the device. It is thus clear that each movement of the pair of arms 22, 24 results in the cutting point (i.e., contact point 12) moving across the web plane 10**. A very rapid repetition rate of cutting strokes is thus possible.

The movement of the arms 22, 24 is produced by movement of a drive rod 34 secured to a piston provided within a double acting cylinder 36. Linkage between the drive rod 34 and each of the arms 22, 24 is in the form of a pair of pivotally interconnected arms 38, 40. Arm 38*a* is pivotally secured to the left end of beam 24 and arm 38*b* is pivotally secured to the right end of beam 22. An arm 40 extends between the opposite ends of each of these arms 38*a* and 38*b* and a "lost motion" connector 41 at the end of the drive rod 34. Additionally, each arm 40 is pivotally secured to its center (as at 42) to the frame 26. As is evident from a comparison of FIGS. 1A, 1B, and 1C, this linkage arrangement converts the linear motion of the drive rod 34 into the rocking motions of the beams 22, 24. As is also apparent, a stroke of the drive rod 34 in one direction produces an entire cutting sequence across the web plane 10 and a return stroke of the drive rod produces another cutting sequence across the web plane 10 in the opposite direction.

Because of the mechanical advantage inherent in the linkage between the piston rod 34 and the beams 22 and 24, the desired full amplitude of rocking movement of the beams can be obtained by employing a relatively short and small diameter cylinder 36. The cylinder size is an advantage not only in being less expensive and occupying less space, but provides for a rapid operation of the cutting apparatus since only a relatively small volume within the cylinder must be filled to the appropriate pressure in order to drive the piston at the time that the pressure side of the double-acting cylinder and piston arrangement is reversed.

Figure 2:
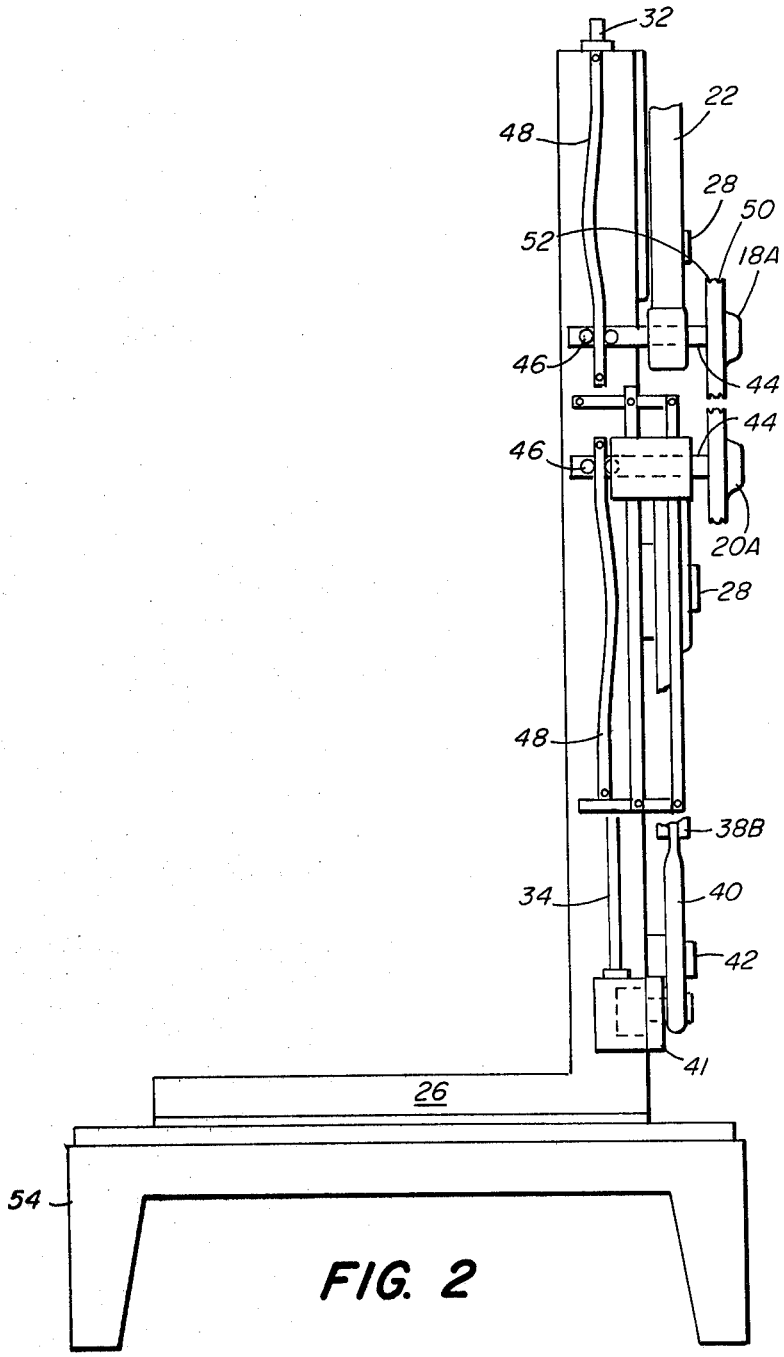
FIG. 2 is an elevational view of one side of the apparatus of FIG. 1.
Figure 3:
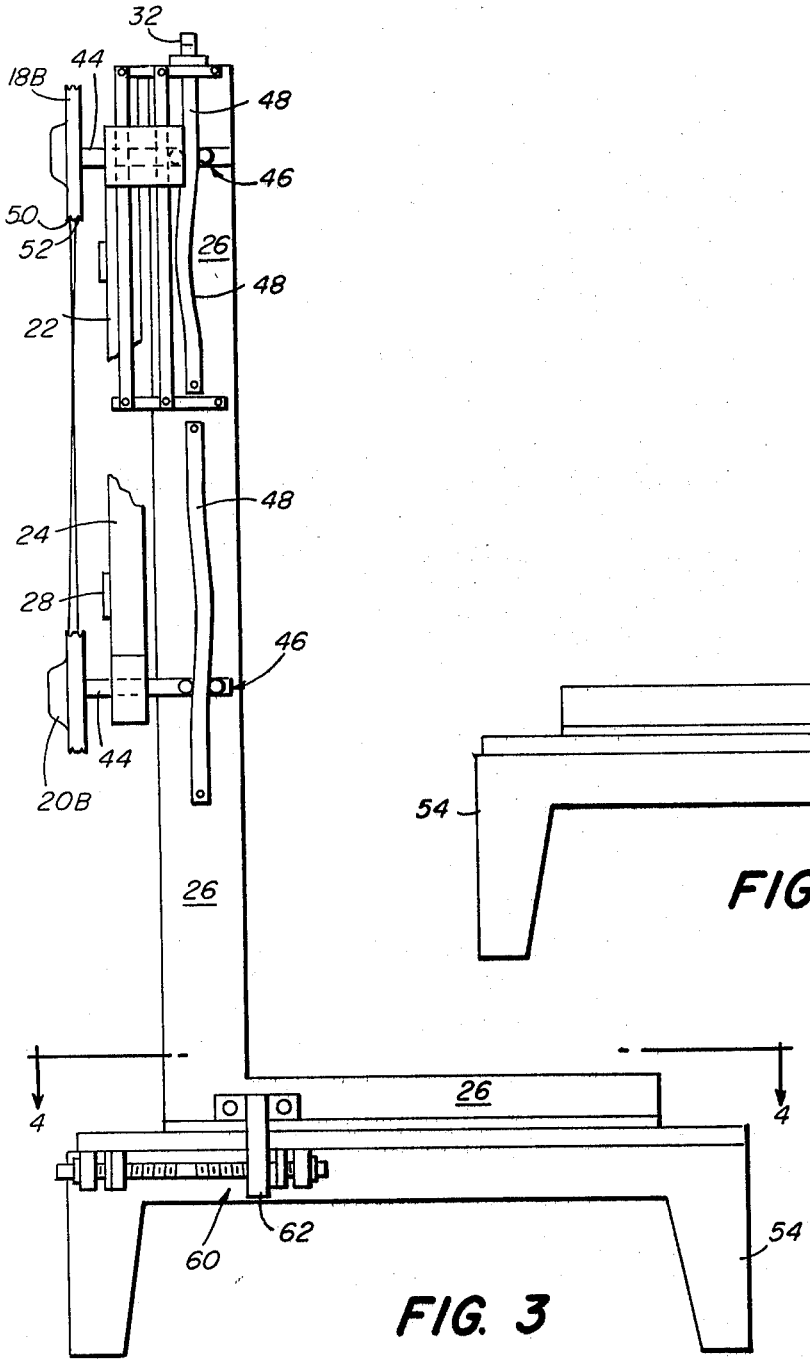
FIG. 3 is an elevational view of the other side of the apparatus of FIG. 1.

Referring to FIGS. 2 and 3, it will be seen that the discs 18*a*, 18*b*, 20*a* and 20*b* are supported on shafts 44 which are, in turn, rotatably supported in the beams 22, 24. Cam followers 46 (in the form of the rollers) at the opposite ends of shaft 44 ride on cams 48*a*, 48*b* secured to the sides of the frame 26. The cams 48*a*, 48*b* are cut such that the rocking motion of the beams 22, 24 produces an attendant in-and-out motion of each of the rollers which are synchronized to cause the two lengths of wire 14, 16 to lie in different planes that intersect at the crossover point 12. This arrangement assures film engagement of the two lengths of wire at the crossover point 12.

Furthermore, each of the discs 18*a*, 18*b*, 20*a*, 20*b* is provided with two peripheral grooves 50 and 52. Groove 50 lies closest to the plane of the respective beam upon which the given disc is mounted. The endless wire is trained about the four discs such that the outermost of the two segments of wire (i.e., segment 16) lies in the grooves 52 of discs 18*b* and 20*a* while the rear wire segment 14 lies in the innermost groove 50 of the discs 18*a* and 20*b*. This arrangement acts as a further assurance of firm engagement of two lengths of wire at the crossover point 12, as is required for a proper cutting action.

In one preferred embodiment the wire that is trained about the pulleys 18 and 20 to provide the cutting wire segments 14 and 16 is 0.020 guage music spring wire seized to form an endless loop. While this choice of wire is suitable, it is not necessary. In fact, various specialty wire shapes, guages, and materials may be desirable for special purpose cutting situations. For example, a square drawn wire might be a desirable choice for the cutting of particularly fibrous materials.

The shape of cams 48*a* in the direction perpendicular to that which causes the in-and-out motion of the discs is that of a circle centered on the respective pivot point 28, since the shafts 44 will move along such a circle. The cams 48*b*, however, have planar surfaces in this perpendicular dimension, thereby constraining the discs 18*b* and 20*a*, and their respective shafts 44, to shift position relative to the beams 22 and 24 as those beams move in their limited swinging motion. This movement of these discs is permitted by a pivotal connection of beam end portions 22*a* and 24*a* to beams 22 and 24. Those end portions are the points at which the linkage rods 38*b* and 38*a* are connected to the beams.

Figure 4:
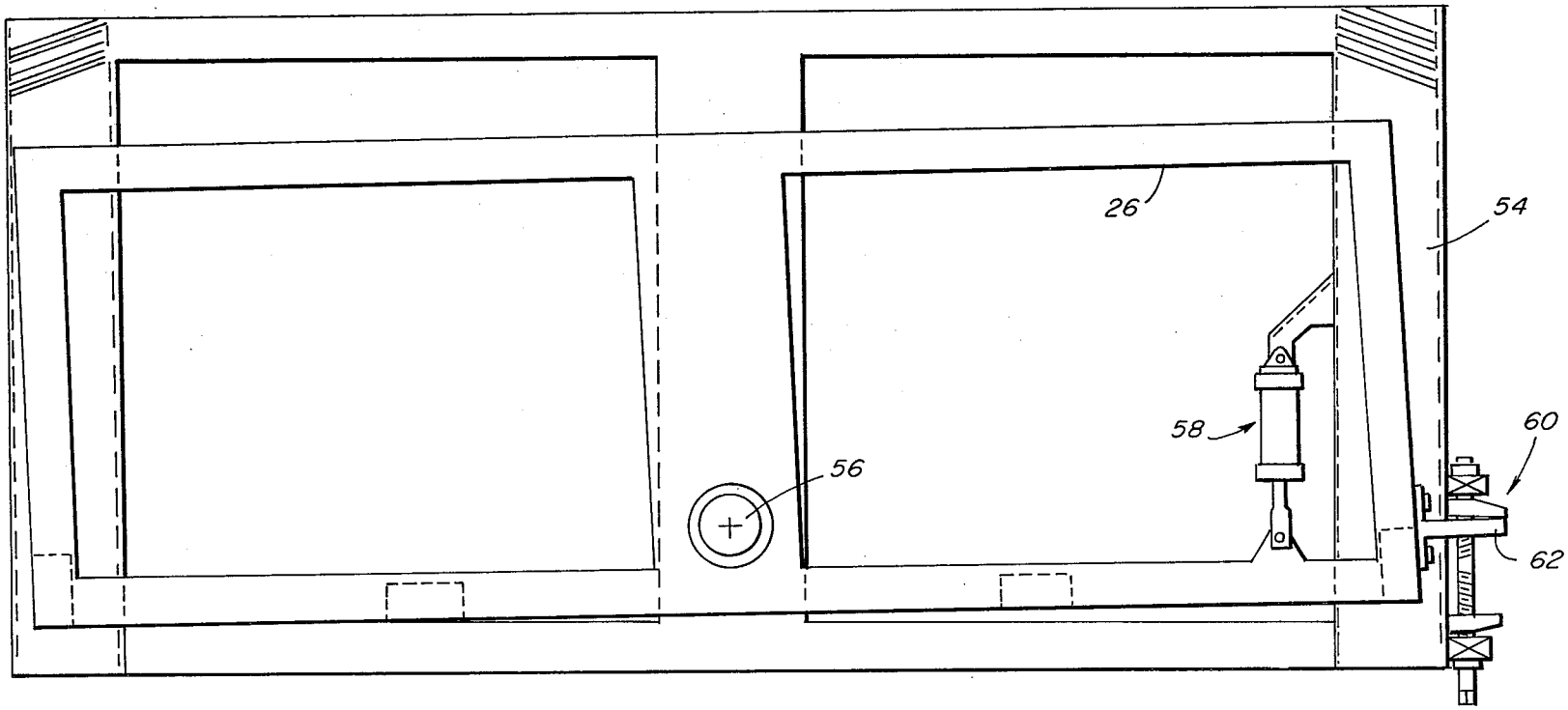
FIG. 4 is a view taken at 4—4 of FIG. 3.

Referring to FIG. 4, it will be seen that the frame 26 is supported by a base 54 for oscillating movement with respect to the base 54 about a pivot point 56. The frame 26 is driven with respect to the base 54 by means of a double-acting cylinder and piston unit 58. An adjustable stop unit 60 mounted on the base 54 can interact with a projecting element 62 of the frame 26 to define the limits of movement permitted under the driving force of the cylinder and piston unit 58. By supplying compressed air to the cylinder and piston unit 58 from a source (not shown) in timed relation with the supplying of such fluid to the cylinder 36 that drives the cutting beams 22 and 24, the entire frame 26 can be pivoted in synchronism with the movement of that cutting point relative to the fixed base 54 and thereby assuring a square cut off of the web despite the fact that the web is moving as it is being cut.

In the operation of the apparatus as described, the apparatus is placed such that the plane 10 of the moving web that is to be cut is positioned approximately centered between the pivot points 28 of the beam 22 and 24. With the apparatus in that position, a cutting wire can be installed by moving the beam 22 toward the beam 24 using the device 30, 32 secured to the beam 22 in order to shorten the "figure 8" length of the endless loop that the cutting wire will take. With the beams in that configuration, the endless wire is trained about the discs 18*a*, 18 *b*, 20*a*, 20*b*, preferably with the wire lying in the groove 50 of disc 18*b* and 20*a* and in the groove 52 of discs 18*a* and 20*b*. The wire is then made taut by withdrawing the beam 22 from the beam 24 until the desired tension and the endless wire loop is achieved at a firm engagement of the wire segments 14 and 16 have the contact point 12 results. With the orientation of the beam 22 and 24 as shown in either of FIGS. 1A or 1C, the web to be cut may be fed through the cutting apparatus along the plane 10 (employing any sunsidiary web support and driving the surfaces, rollers, etc. as required).

The movement of the web and the supply of timed pulses of compressed air from a supply (not shown) to the cylinder 36 can then be initiated, simultaneously. The result is a continuous cyclical rocking motion of the two beams 22 and 24 with the resultant travel of the cutting point 12 between the wire segments 14 and 16 in successively opposite directions across the width of the web plane 10. Because the cutting occurs at a substantially single point at any given instant (i.e., a moving point of contact 12 between the two wire segments), the material of the web is allowed to move through the cutting apparatus while the cutting operation takes place. A simultaneous pivoting motion of the main frame 26 compensates for the travel of the web during the time it takes the cutting point 12 to move across the width of the plane 10 and end in a result in a square cut off of the web.

While a particular preferred embodiment of the present invention has been illustrated in the accompanying drawings and described in detail herein, other embodiments are within the scope of the invention and the following claims.

What is claimed is:

1. Cutting apparatus comprising first and second wire segments that contact each other at substantially a single point and that are segments of a single continuous loop of wire, means for maintaining each wire segment taut comprising first and second spaced apart beams, each supported for limited rotational motion about a pivot point and each including spaced apart bearing members about which said single wire is trained, and means for moving at least one of said segments relative to the other to cause the point of contact to move along each of the segments.

2. The cutting apparatus of claim 1 wherein each said bearing member comprises a disc supported on its respective beam for rotation with respect thereto, said wire lying in a peripheral groove in said disc.

3. The cutting apparatus of claim 2 wherein said first wire segment extends between a disc at one end of a first beam and a disc at the other end of a second beam, said second wire segment extending between the remaining two discs, the peripheral grooves of the discs engaged by said first wire segment being at an axial location on each disc that is closer to its respective beam than are the respective peripheral grooves engaged by the second wire in the discs that it engages; thereby enabling a maintenance of rubbing contact between said first and second wire segments as said movement of said point of contact occurs.

4. The cutting apparatus of claim 1 wherein said means for maintaining each wire segment taut further comprises means for moving the pivot point of one of said beams relative to the pivot point of the other beam.

5. The cutting apparatus of claim 1 wherein said means for moving at least one of said wire segments relative to the other comprises means for reciprocally driving said first and second beams with simultaneous rotary movement about their respective pivot points with opposite senses of rotation.

6. The cutting apparatus of claim 5 further comprising a single beam drive means and a linkage connecting said drive means to one end of said first beam and the other end of said second beam, whereby said single drive means causes movement of each said beam about its respective pivot point with a sense of rotation opposite that of the other beam.

7. The cutting apparatus of claim 6 wherein said single drive means comprises a double-acting piston and cylinder arrangement.

8. The cutting apparatus of claim 7, the cutting apparatus further including a frame means, said beams, said cylinder, and said linkage all supported on said frame means.

9. Cutting apparatus comprising first and second wire segments that contact each other at substantially a single point and that are segments of a single continuous loop of wire, means for maintaining each wire segment taut comprising first and second spaced apart beams, each supported for limited rotational motion about a pivot point and each including spaced apart bearing members about which the single wire is trained, and means for moving at least one of said wire segments relative to the other to cause the point of contact to move along each of said segments comprising means for reciprocally driving said first and second beams with simultaneous rotary movement about the respective pivot point with opposite senses of rotation, further including means for moving at least one disc of each beam relative to its beam as the beam is rotated.

10. The cutting apparatus of claim 9 wherein said first and second beams are pivotally supported on a frame, each said disc being secured to a shaft supported on a beam for rotary motion with respect to the beam and extending through the beam, the shafts of said two discs that are movable with respect to their respective beams further including cam follower means on the opposite side of said beam from the disc, said apparatus further including cam means engageable with said cam follower means to drive said discs in a direction parallel to said shaft as said cam follower means engage said cam means during the movement of said beams.

11. The cutting apparatus of claim 10 wherein the shaft of each said disc is provided with cam follower means and wherein cam means are provided on said frame for engagement with each said cam follower means.

12. The apparatus of claim 11 wherein with respect to each said beam, one of said cam means for driving said discs is shaped to cause longitudinal movement of said disc shaft relative to the pivot point of the respective beam, the shaft engaged with that cam means being mounted with respect to its beam to permit such movement.

* * * * *